US009451813B1

(12) United States Patent
Cipolla

(10) Patent No.: US 9,451,813 B1
(45) Date of Patent: Sep. 27, 2016

(54) METHOD OF MAKING SELF-STOPPING BEADS

(71) Applicant: Steven A. Cipolla, Warwick, RI (US)

(72) Inventor: Steven A. Cipolla, Warwick, RI (US)

(73) Assignee: NATIONAL CHAIN COMPANY, Warwick, RI (US)

( * ) Notice: Subject to any disclaimer, the term of this patent is extended or adjusted under 35 U.S.C. 154(b) by 0 days.

(21) Appl. No.: 14/529,977

(22) Filed: Oct. 31, 2014

Related U.S. Application Data

(60) Provisional application No. 62/007,507, filed on Jun. 4, 2014.

(51) Int. Cl.
*A44C 27/00* (2006.01)
*A44C 11/00* (2006.01)
*A44C 25/00* (2006.01)

(52) U.S. Cl.
CPC ..... *A44C 25/00* (2013.01); *A44C 27/00* (2013.01); *A44C 27/001* (2013.01); *A44C 11/002* (2013.01)

(58) Field of Classification Search
CPC .... A44C 27/00; A44C 25/00; A44C 25/007; A44C 25/001
USPC ..... 29/896.41
See application file for complete search history.

(56) References Cited

U.S. PATENT DOCUMENTS

| | | | | |
|---|---|---|---|---|
| 6,470,571 | B1 * | 10/2002 | Namiki | A44C 11/005 29/417 |
| 6,557,376 | B2 * | 5/2003 | Pratt | 63/3 |
| 6,722,036 | B2 * | 4/2004 | Pratt | 29/896.41 |
| 7,409,763 | B2 | 8/2008 | Pratt | |
| 2002/0148250 | A1 * | 10/2002 | Pratt | 63/3 |
| 2003/0121150 | A1 * | 7/2003 | Pratt | 29/896.4 |
| 2008/0022718 | A1 * | 1/2008 | Pratt | 63/3.1 |
| 2009/0162816 | A1 * | 6/2009 | Charles | A44C 5/0015 434/127 |
| 2012/0080140 | A1 * | 4/2012 | Arebalo | A44C 25/00 156/166 |

* cited by examiner

*Primary Examiner* — Emily Morgan
(74) *Attorney, Agent, or Firm* — Salter & Michaelson

(57) ABSTRACT

A method of making a self-stopping bead for jewelry. The method comprises the steps of: inserting a resilient tube with an axial passage lengthwise into a relatively rigid tube having a longitudinal axis; deforming the rigid tube inward toward said axis at at least first and second spaced-apart locations along said axis until the rigid tube is necked down at said locations enough to pinch the resilient tube at a depression; and severing the rigid tube and the resilient tube at said depressions thereby forming a self-stopping bead with opposing holes wherein during the step of deforming, the rigid tube and the resilient tube are pinched off so that each hole in the bead receives therein an end of the resilient tube so that the resilient inner tube has a length substantially the same as an axial length of the self-stopping bead between the opposed bead holes.

8 Claims, 5 Drawing Sheets

METHOD OF MAKING SELF-STOPPING BEADS

RELATED CASES

Priority for this application is hereby claimed under 35 U.S.C. §119(e) to commonly owned and U.S. Provisional Patent Application No. 62/007,507 which was filed on Jun. 4, 2014 and which is incorporated by reference herein in its entirety.

FIELD OF THE INVENTION

The present invention relates in general to jewelry. More particularly, the present invention relates to jewelry that includes an array of beads or other ornaments strung on a support such as a chain or wire. Even more particularly, the present invention relates to an improved self-stopping bead and its method of manufacture.

BACKGROUND OF THE INVENTION

A necklace is often constructed of a series of beads strung on an elongated slender support, such as a chain, wire, string, etc., which can be hung around a person's neck. In some cases, the number of beads on the support is such that the beads occupy substantially the entire length of the support. In other cases, the beads are arranged in groups spaced apart along the length of the support with the beads in each group often having different sizes. In the latter case, one may take steps to provide stops for at least the end beads of each group in order to maintain the integrity of each group and the spacing between adjacent groups along the support. In the past the stops may include drops of solder on the support that bracket each group. In the case of chains, the bracketing links may be flattened or deformed in some way so that they cannot pass through the holes in the adjacent beads. When the bead support is a string, the string can be knotted at the opposite ends of each bead group to provide stops.

With past jewelry items one disadvantage is that, once the beads or other ornaments are strung, there is no possibility to rearrange them along the support. As one may imagine, this limits the utility of the necklace or other jewelry article. For example, while a given woman's necklace may coordinate well with one dress or blouse, it may not look pleasing with another dress or blouse having a different style or neckline. Consequently, a woman may have to purchase many different necklaces in order to satisfy her wardrobe requirements. Needless to say, this can result in a considerable expense, particularly if the necklaces are of a precious metal such as silver or gold.

One bead stop arrangement is shown in patents to Pratt U.S. Pat. Nos. 6,557,376 and 6,722,036 which incorporate an inner resilient plastic tube within an outer metal shell. One of the disadvantages of that structure is that there may be a close tolerance between the inner plastic tube and the outer metal shell resulting in an undesired motion between the inner plastic tube and the outer metal shell. This can cause a sliding motion of the inner plastic tube relative to the outer metal shell thus defeating the "stop" action. Also, the existing teachings do not provide any means by which one can adjust the dimensions of the bead, particularly the passage holes in the bead, to compensate for the use of the beads with different size and type of support.

Accordingly it is an object of the present invention to provide a beaded belt, necklace, bracelet, anklet and or other jewelry article whose beads can be arranged in different groupings along a chain or other elongated support.

Another object of the invention is to provide a jewelry article comprising a plurality of beads and/or other ornaments strung on a support wherein the beads and/or other ornaments can be adjustably grouped along the support.

Still another object of the invention is to provide a necklace or other jewelry article comprising an elongated slender support having one or more beads adjustably positioned along the support.

A further object of the invention is to provide an adjustable self-stopping bead for a necklace or other jewelry article, and in which the inner tube part of the bead is more securely positioned relative to the outer metal shell of the bead.

Yet another object of the invention is to provide a method of making an adjustable self-stopping bead for a necklace and or other jewelry article, and in which the method can be carried out more effectively than in the past.

Still another object of the invention is to provide a jewelry item employing beads or the like and in which means are provided by which one can adjust the dimensions of the bead, particularly the passage holes in the bead, to compensate for the use of the beads with different size and type of support or chain.

SUMMARY OF THE INVENTION

The jewelry in accordance with the present invention includes an elongated slender support having strung thereon a series of beads and/or other ornaments one or more of which is a self-stopping bead whose position along the support can be adjustably fixed. This allows the beads or other ornaments on the support to be variably grouped along the length of the support to suit the desires of the wearer. The support may be any one of a variety of known members such as a chain, solid or braided wire, tubular wire, string, monofilament wire or the like.

Each of the adjustable self-stopping beads comprises a hollow shell having a pair of holes therein through which the bead support may be threaded. The bead also has incorporated therein at the time of its manufacture a short flexible resilient tube which is aligned with the shell and preferably disposed so that the ends of the tube extend completely through the shell opposed holes. When that bead is strung on the support, the segment of the support within the tube is resiliently engaged by the wall of the tube such that an appreciable force is required in order to slide that bead along the support. Consequently, the self-stopping beads allow the variable grouping of other, freely slidable, beads or ornaments along the support. With the stop bead arrangement of the present invention a wide variety of different ornamental groupings are possible for a given piece of jewelry.

In accordance with the present invention there is also provided a method of making a self-stopping bead for jewelry. The method comprises the steps of: inserting a resilient tube with an axial passage lengthwise into a relatively rigid tube having a longitudinal axis; deforming the rigid tube inward toward said axis at at least first and second spaced-apart locations along said axis until the rigid tube is necked down at said locations enough to pinch the resilient tube at a depression; and severing the rigid tube and the resilient tube at said depressions thereby forming a series of self-stopping beads each with opposing holes wherein during the step of deforming, the rigid tube and the resilient tube are pinched off so that each hole in the bead receives therein an end of the resilient tube so that the resilient inner tube has a length substantially the same as an axial length of the self-stopping bead between the opposed respective bead holes outer flush surfaces.

DESCRIPTION OF THE DRAWINGS

For a fuller understanding of the nature and objects of the invention, reference should be made to the following detailed description taken in connection with the accompanying drawings, in which.

DETAILED DESCRIPTION

Figure 7:
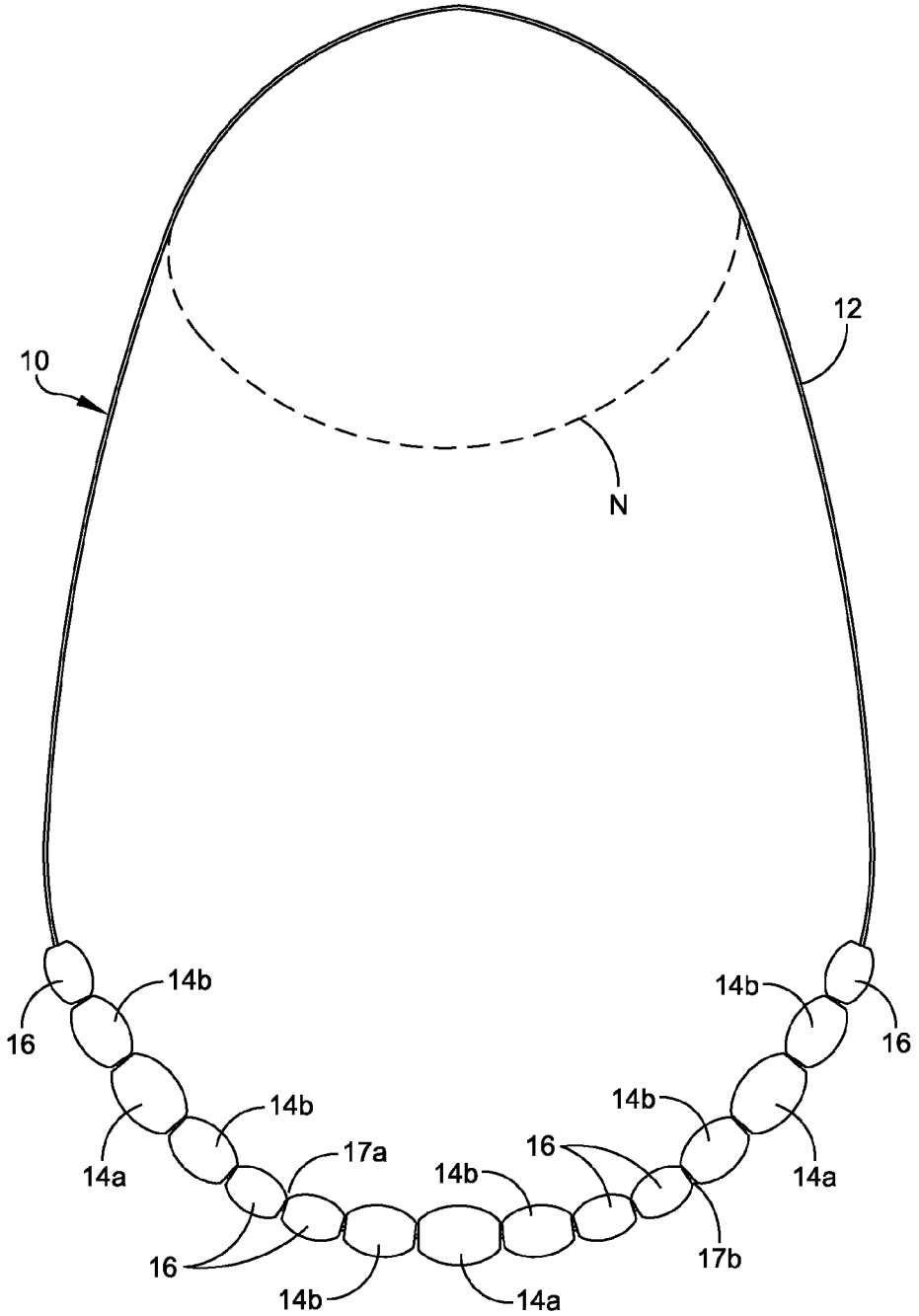
FIG. 7 is a schematic representation of a necklace embodying the stop bead of the present invention.

Referring first to FIG. 7 of the drawings, a necklace 10 incorporating the invention is shown hung around a wearer's neck N. The illustrated necklace includes a bead support in the form of a chain 12 that may be composed of interlocking links or may be a rather straight chain construction. The chain may be formed of any metal or other material suitable for making jewelry. When in use, the chain 12 forms a loop around the wearer's neck N, as shown in FIG. 7. The illustrated necklace 10 may have relatively large beads 14*a* and somewhat smaller beads 14*b* on opposite sides of each bead 14*a*. The necklace also includes a plurality of adjustable self-stopping beads 16. In the illustrated necklace, the beads 16 may be smaller than beads 14*b* and there is a self-stopping bead 16 adjacent to each bead 14*b*. The beads 16 enable all of the beads to be adjustably grouped along chain 12. Thus in one necklace format, all of the beads can be clustered at the lower end of the necklace as shown in FIG. 7. Alternatively, the two left-most self-stopping beads may be raised up on the left-hand stretch of the necklace and the two right-most beads may be raised up on the right-hand stretch of the necklace to form two upper bead groupings, leaving a third bead group at the bottom of the necklace such as between locations 17*a* and 17*b* in FIG. 7. In another variation, the two end beads on the necklace can be moved farther up on the chain to provide still another design effect. Thus, by variously positioning the self-stopping beads 16 along chain 12, the single necklace can be transformed to have a variety of different bead configurations to coordinate with the different garments in the wearer's wardrobe. Each grouping has at least one stop bead 16 at each end of the bead grouping to hold that particular bead grouping in place on the chain. While necklace 10 has only one ornamental strand it is obvious that the invention can be incorporated into a multiple strand necklace which would allow a variety of different bead grouping along the different strands. The support may be any one of a variety of known members such as a chain, solid or braided wire, tubular wire, string, monofilament wire or the like.

Figure 5:
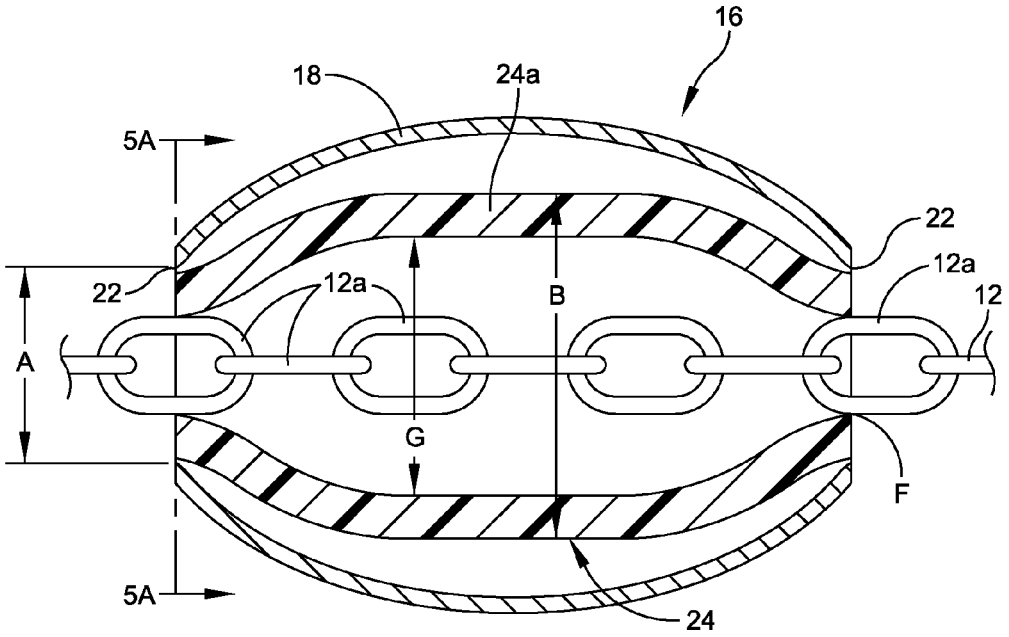
FIG. 5 is a cross-sectional view through the final bead product.
Figure 5A:
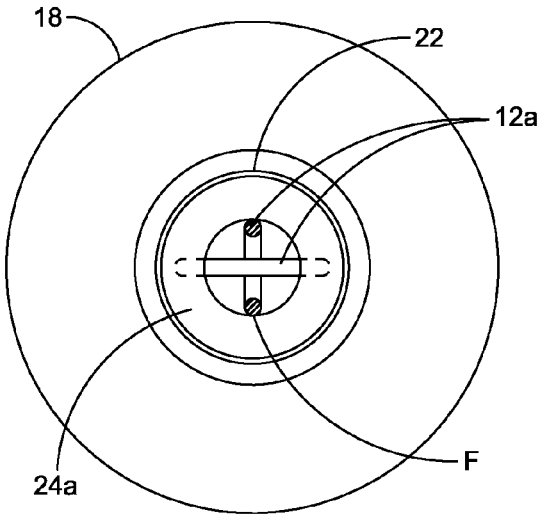
FIG. 5A is an end view of FIG. 5 at line 5A-5A.
Figure 6:
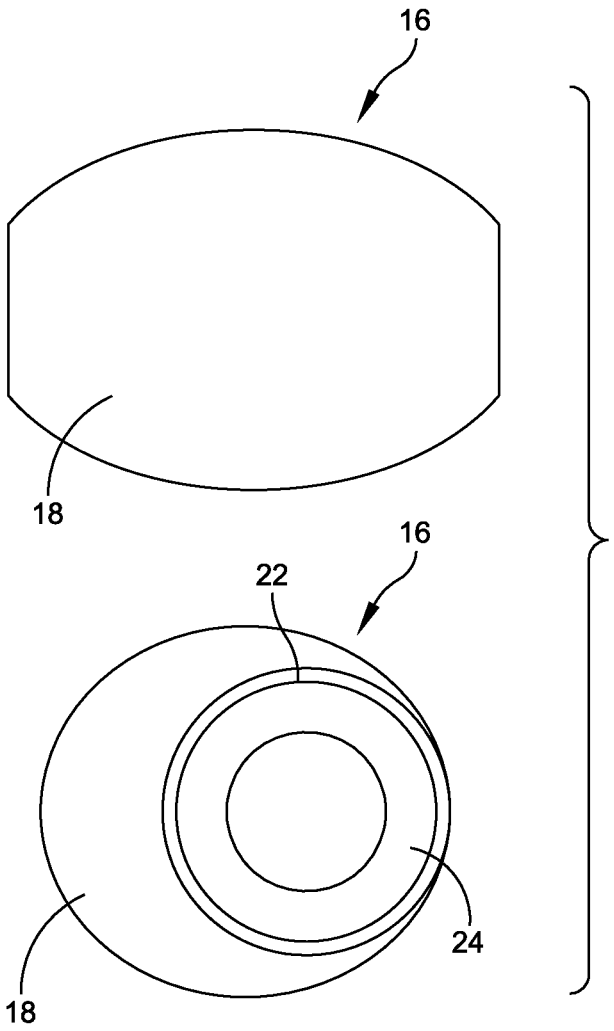
FIG. 6 illustrates separate positions of the final bead product including where the inner plastic tube extends completely to an outside flush surface with the bead hole.

Referring now to FIGS. 5 and 6, each self-stopping bead 16 comprises a thin shell (tube) 18 of any metal, alloy or other deformable material suitable for making jewelry, e.g. gold, silver, platinum, stainless steel, brass, etc. The shell 18 has a pair of opposing holes 22 sized to receive the chain 12 so that the bead 16 can be strung on the chain. At the time of its formation, the shell 18 is provided with an internal tube 24 which is aligned with holes 22. Refer in FIG. 5 to dimension "A" for the hole 22 diameter. Preferably, tube 24 is of a relatively hard plastic material, preferably polyurethane. Due to the method of installing the tube in shell 18, the outside diameter of the tube (dimension "B" in FIG. 5) corresponds, at the hole 22, substantially with the diameter of holes 22 and thus the inside diameter (dimension "G" in FIG. 5) of the tube is smaller than those holes 22, at each hole 22 As illustrate in FIG. 5, the outer diameter of the tube 24 is substantially the same as the hole 22 diameter so that the tube 24 extends preferably completely through the holes 22 at both sides of the bead to the flush end at "F". This provides a secure interlock between the tube 24 and the outer metal shell (tube) 18. When the bead 16 is strung on chain 12, the links 12*a* of the chain within the tube are resiliently engaged by the tube wall such that when the bead 16 is slidably positioned at a selected location on chain 12, the bead remains at that location until an appreciable force is applied to slide the bead to a different location along the chain. In the cross-sectional view of FIG. 5 the tube 24 is shown somewhat exaggerated in diameter at its middle section 24*a*.

Figure 1:
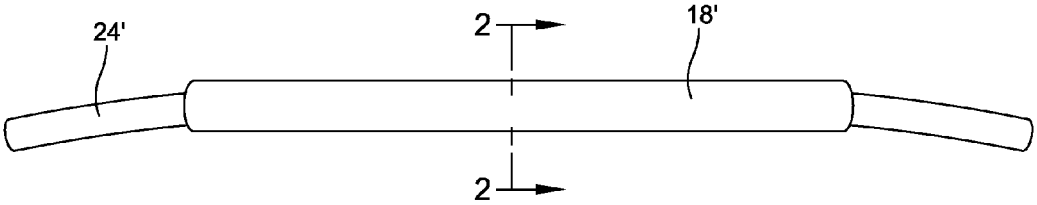
FIG. 1 is an illustration of the main components comprising the bead fo the present invention.
Figure 2:
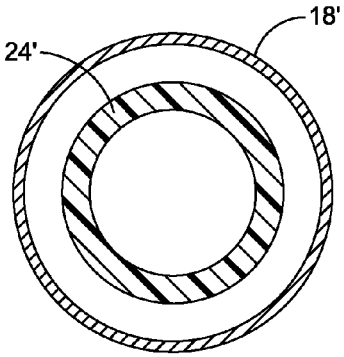
FIG. 2 is a cross-sectional view taken through the metal shell and plastic tube as taken along line 2-2 of FIG. 1.
Figure 3:
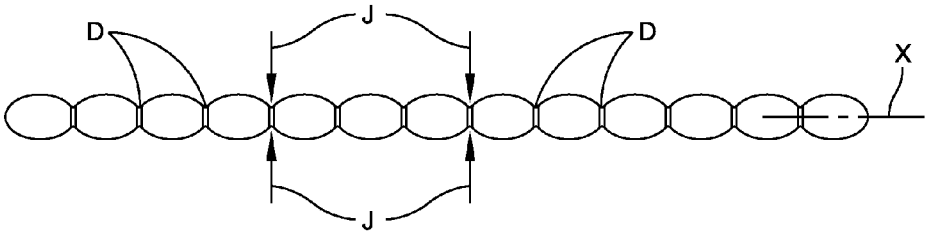
FIG. 3 is an illustration of a next step in the process of forming the beads showing the metal shell (tube) having been formed by means of hammers or other members that provide a depression.
Figure 4:
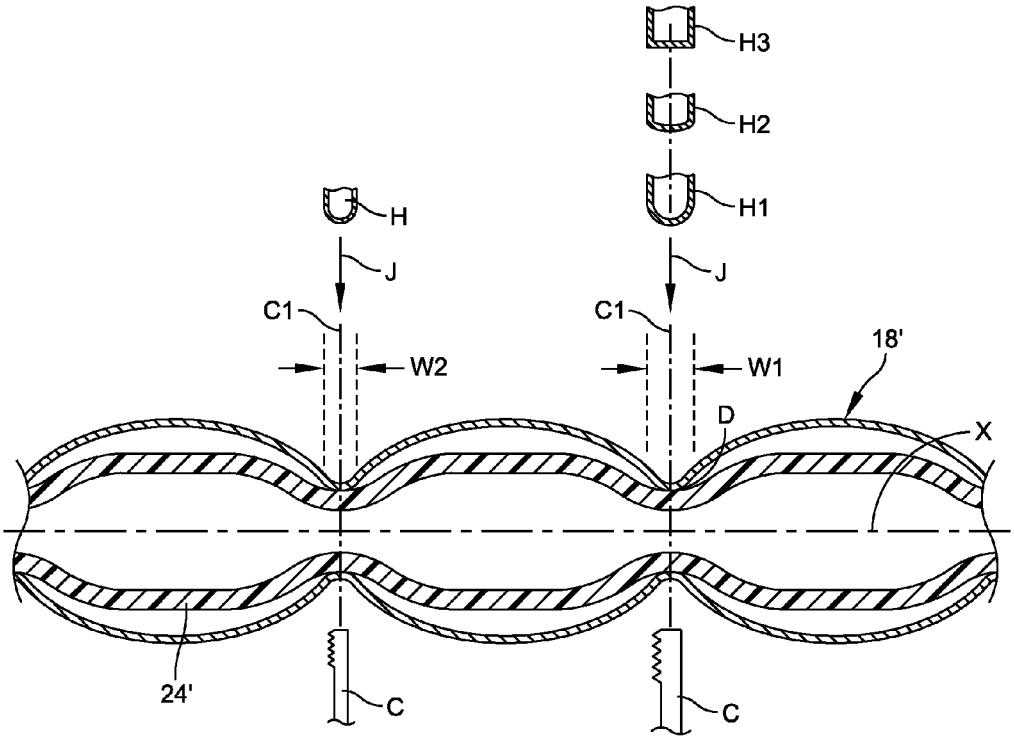
FIG. 4 is a longitudinal cross-sectional view of the outer metal tube and inner plastic tube illustrating the depressions and associated cutting means.

Referring now to FIGS. 1-4, the beads 16 are formed from a long tube 18' by progressively deforming the tube. However, prior to deforming the tube, a small diameter flexible resilient tube 24' is inserted into tube 18'. Preferably tube 24' is as long as or longer than tube 18'. Following insertion of the tube 24' in tube 18', while rotating tube 18' about its longitudinal axis, the tube 18' is advanced past a succession of hammers or dies H indicated schematically by the arrows J in FIGS. 3 and 4. The hammers H drive progressively closer to the rotary axis X so that tube 18' is progressively deformed as indicated in FIG. 4 as viewed from left to right. In other words, the first hammer H makes a slight circular deformation in the otherwise straight tube 18'. That circular deformation may then travel to a second hammer which makes a slightly deeper deformation in the tube. That slightly deeper deformation may then be advanced to a third hammer which deepens the deformation even more, and so on, until the tube is deformed or crimped to such an extent that the wall of the tube 18' is necked down so that it actually pinches the resilient tube 24' as shown at depression D in FIGS. 3 and 4. At that point, the diameter of the tube 18' has been reduced to an extent that it is almost pinched off. This hammering action thus forms a more or less oval bead structure at 18' which is connected to the rest of tube basically only at the small neck remaining at the depression D. Tube 18' is then advanced past a cutting device C (for severing the bead) which cuts the tube at the depression D so that the protoshell 18 is formed with the resilient tube segment therein being separated from the remainder of tubes 18' and 24', respectively, thereby forming a series of self-stopping beads 16 each with holes 22 as shown in FIG. 5. The cutting is preferably by means of a saw cutter to be described further hereinafter.

The particular shape of beads 16 is determined primarily by the shapes of the hammers or dies and the cross-sectional shape and inner and outer diameter dimensions of tube 18'. In the illustrated necklace, the hammers H are spaced-apart a distance related to the cross-section of tube 18 so the beads are preferably oval. However, many other bead shapes are possible, e.g. round, cube, polyhedron, oblate spheroid, etc. The hammers, or the like, can be controlled in opposed direction as indicated by the arrows J in FIG. 3. Alternatively, a hammer may be used against an opposed anvil to form the depression. The shell deformation may be controlled in a single step with a single strike or multiple steps with successive hammer strikes. The metal tube may be moved incrementally to provide successive strikes. Alternatively, several hammer elements can be grouped in series and actuated concurrently.

The links 12*a* of chain 12, which are sized to fit through the holes 22 in shell 18, have a maximum diameter or width which is slightly larger than the inside diameter of tube 24, at the hole 22, so that the links are resiliently engaged by the wall of the tube thereby preventing the free sliding movement of the bead 16 along the chain. That is, in order to move the bead along the chain, the chain can be held stationary and an appreciable force applied to the bead in a direction parallel to tube 24. Because the inner tube extends into the bead holes on both sides of the bead, this provides a firm interlock between the tube and shell. Thus, the tube remains fixed in position relative to the shell providing a secure locking of the bead to the support while still allowing some limited sliding motion of the bead along the support with the application of some reasonable force against the bead. This interlock at the hole 22 between the tube 24 and shell 18 also provides a rather fixed positioning of the end of the resilient tube 24 (at the flush surface F) so that there is a firm engagement of the chain at each chain link with the inner surface of the tube 24 at end flush area F.

With further reference to FIGS. 1-4, it has been found in accordance with the present invention that an improved interlock is provided between the inner plastic tube 24 and the outer metal tube 18 by selecting a particular material for the plastic tube and providing certain dimensions of the plastic tube to attain the desired results. In this regard the metal shell or tube 18'(FIGS. 1 and 2) is a sterling tube that may have an outer diameter of 0.180 inch and a wall thickness of 0.006 inch (inner diameter of 0.168 inch). Into the tube 18' one inserts a polyurethane tube that may have an outer diameter of 0.125 inch and a wall thickness of 0.0156 (inner diameter of 0.0938 inch). It has been found that a relatively hard polyurethane provided improved results in order to provide an enhanced interlock of the plastic tube with the outer shell. It was found that if the hardness is too soft the tube did not stay within the shell hole and thus there is a critical hardness or range of hardness that enabled the proper interlock. This enabled the inner tube to remain stationery as a chain is pulled through the bead or as the bead is moved relative to the chain. Softer materials for the inner tube such as silicone did not provide the desired interlock as they tended to pull away from the shell. The preferred polyurethane used had a 85 A durometer hardness, and ones that were most effective had a durometer hardness of at least 60 A. It has also been found that the plastic inner tube should not be too hard as then the inner plastic tube does not display sufficient resiliency to provide some yielding relative to the support member. The preferred range of hardness on the Shore "A" scale has been found to be between 60 A and 95 A.

The diagram of FIG. 4 actually depicts both the deformation step (arrows J) and the severing step (means C). These are separate steps but for the sake of simplicity are both shown in FIG. 4. FIG. 4 also shows by the arrows J a direction of the hammer, or the like. FIG. 4 also depicts different shapes for the hammer depending upon the particular application. Progressively from top to bottom in FIG. 4 the hammer head has a more rounded configuration. At H1 it is quite rounded; at H2 it is less rounded; and at H3 it is virtually squared. Each of these different hammer configurations will provide a different shaped depression.

Regarding the severing step, a saw blade has been used. See FIG. 4 and the illustration of a severing means at C. In order to provide a uniform bead construction on both sides of the bead, each cut is centered at centerline C1. However, different width blades may be used to provide different size bead ends where the plastic tube is flush with the metal tube as at F in FIG. 5. FIG. 4 depicts two different cutting widths W1 and W2; each dependent upon the blade width. The cut at W1 is wider than the cut at W2. In essence by controlling the blade width this essentially controls the width of each bead. A wider blade makes for a narrower bead; and a narrower blade makes for a wider bead. This also controls the tension imposed at the bead between the bead insert and the chain or other support. The wider the saw blade, the further in from the end of the bead the saw makes a cut, thus allowing for a slightly bigger bead hole. This would be helpful when the support is larger in diameter such as for a larger size chain, whereby the bead would fit better with the larger chain while yet enabling the same sliding and locking motion between the bead and support. This blade selection thus allows the use of different size chains while still keeping a similar friction tension on basically the same size oval or round bead construction.

Another parameter that can be varied is the particular size of the inner and outer tubes. One may use larger or smaller metal pieces of tubing or larger or smaller plastic inserts depending upon the final product that is to be formed. In one example provided the metal shell or tube may have an outer diameter of 0.180 inch and a wall thickness of 0.006 inch, and the polyurethane tube may have an outer diameter of 0.125 inch and a wall thickness of 0.0156. It is preferred that the wall thickness of the metal tube be thinner than the wall thickness of the plastic tube as relatively represented in FIG. 4.

One use of the slide bead is to be able to lengthen or shorten the necklace or bracelet. There are several ways to use one slide bead threaded in various manners with the chain or chord to fix the chain or chord at a certain length. This makes the use of the slide bead important in adjusting the length of the chord or chain by repositioning the slide bead. Also, in FIG. 1 there is just shown a random length of the tubes 18' and 24'. In actuality, there are a number of different lengths that may be employed. It will thus be seen that the objects set forth above, among those made apparent from the preceding description, are efficiently attained. Also, certain changes may be made in carrying out the above method and in the construction set forth without departing from the scope of the invention. For example, the self-stopping beads 16 may be used to adjustably group beads or other ornaments even in small jewelry articles such as earrings, pins and brooches. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A method of making a self-stopping bead for jewelry, said method comprising the steps of:

providing a rigid metal tube having an axial passage that extends along a longitudinal axis of the rigid metal tube;

providing a resilient relatively hard plastic tube;

inserting the resilient plastic tube within the axial passage of the rigid metal tube;

deforming the rigid tube inward toward said axis at at least first and second spaced-apart locations along said axis until the rigid tube is necked down at said locations enough to pinch the resilient tube at a depression;

wherein the deforming step includes substantially equal deformation at any one location at opposed sides of the rigid metal tube so as to form a uniform bead shape;

wherein the resilient and rigid tubes are provided in sections including at least a first section where a first bead is formed and a second section where a second bead is formed;

severing the rigid tube and the resilient tube at said depressions thereby forming a self-stopping bead with opposing holes that are formed at opposed substantially planar end surfaces of the bead;

wherein the step of severing forms ends of the resilient tube that extend into and interlock with the respective holes in the rigid tube;

wherein the step of severing includes selecting a first saw blade to cut the rigid tube and the resilient tube at a first pair of depressions of said first section, and wherein the first saw blade is selected to have a first width to provide a first bead of a first uniform width which, in turn, defines a first uniform bead hole width;

wherein the first pair of depressions are adjacently disposed depressions and the severing is accomplished by centering the first saw blade at a center line of the respective depression to form a uniform first bead;

wherein the step of severing further includes separately selecting a second saw blade to cut at a second pair of depressions of said second section, and wherein the second saw blade is selected to have a second width to provide a second bead of a second uniform width which, in turn, defines a second different uniform bead hole width;

wherein the second pair of depressions are adjacently disposed depressions and the severing is accomplished by centering the second saw blade at a center line of the respective depression to form a uniform second bead;

wherein the first saw blade width is greater than the second saw blade width so that the first bead hole of the first bead that is formed has a width greater than the second bead hole width of the second bead that is formed.

2. The method of claim 1 wherein the step of severing the rigid tube leaves each bead with the resilient tube having end faces that are flush with end surfaces of the rigid metal tube.

3. The method of claim 1 wherein the step of deforming includes providing a hammer device for striking the rigid metal tube.

4. The method of claim 3 including providing opposed hammer devices on opposed sides of the rigid metal tube, and wherein each hammer device includes a surface that is at least partially rounded.

5. The method of claim 3 including a hammer device on one side of the rigid metal tube an anvil on an opposed side of the rigid metal tube.

6. The method of claim 1 including providing the resilient plastic tube of a plastic of a shore A hardness range of 56 A to 90 A.

7. The method of claim 1 wherein the step of deforming includes using a hammer device to strike the rigid metal tube with the rigid metal tube being moved incrementally to provide successive strikes.

8. The method of claim 1 wherein the step of deforming includes providing a plurality of spaced apart hammer devices for concurrently striking the rigid metal tube while the rigid metal tube remains stationary.

* * * * *